United States Patent [19]

Meyer et al.

[11] 4,013,249

[45] Mar. 22, 1977

[54] AUXILIARY MOTOR MOUNTING ASSEMBLY

[75] Inventors: Martin H. Meyer, Waukegan, Ill.; Robert Zakrzewski, Franklin, Wis.

[73] Assignee: Outboard Marine Corporation, Waukegan, Ill.

[22] Filed: Dec. 3, 1975

[21] Appl. No.: 637,108

[52] U.S. Cl. ..... 248/4; 115/17

[51] Int. Cl.[2] ..... B63H 21/26

[58] Field of Search ..... 248/4, 284; 115/17, 115/41 R, 41 HT

[56] References Cited

UNITED STATES PATENTS

| | | | |
|---|---|---|---|
| 2,643,837 | 6/1953 | Rivers | 248/4 |
| 3,003,724 | 10/1961 | Kiekhaefer | 248/4 |
| 3,245,641 | 4/1966 | Hart | 115/41 R |
| 3,460,505 | 8/1969 | Thoene | 248/4 X |
| 3,667,714 | 6/1972 | Ziaylek | 248/284 |
| 3,785,329 | 1/1974 | Shimanckas | 115/41 R |
| 3,863,592 | 2/1975 | Borst | 248/4 X |

*Primary Examiner*—J. Franklin Foss
*Attorney, Agent, or Firm*—Michael, Best & Friedrich

[57] ABSTRACT

Disclosed herein is a mounting device for a marine propulsion device comprising a first bracket adapted to be attached to a boat and having upper and lower parts, a second bracket adapted to support a marine propulsion device and having upper and lower parts, an upper link pivotally connected at its end to the upper parts of the first and second brackets, a lower link pivotally connected at its ends to the lower parts of the first and second brackets, whereby to permit swinging of the second bracket relative to the first bracket between raised and lowered positions, a linkage for selectively holding the second bracket in the first and second positions including a slot and a stud engaged in the slot, a spring for selectively and yieldably biasing one of the slot and the stud for engagement with the other so as to selectively retain the second bracket in either of the raised and lowered positions.

29 Claims, 5 Drawing Figures

47
35
45
23
95
33
89
37
77
71
87
75
79
73
83
81
85
43
55
51
53
25
89
101
103
97
99
95
11
45
23
103
31
91
21
93
17
13
61
57
27
41
33
47
15

247
215
271
272
237
255
272
271
273
259
258
253
225
235
279
275
257
277
261
260
301
211
221
243
247
299
303
245
305
295
297
223
231
227
213
217
241
233
5
5

217
213
243
237
235
245
277
275
273
211
225
247
290
279
280
286
261
251
284
303
292
282
286
297
225
243
245

AUXILIARY MOTOR MOUNTING ASSEMBLY

BACKGROUND OF THE INVENTION

The invention relates generally to devices for supporting marine propulsion devices, such as outboard motors. More particularly, the invention relates to supporting devices which are capable of selectively supporting an outboard motor in either raised or lowered positions.

Still more specifically, the invention relates to supporting devices of the general type which include a parallelogram linkage.

Examples of prior art outboard motor supporting devices which include outboard motor supporting linkages are disclosed in the following U.S. Pat. Nos.:

Lang 3,075,490 issued Jan. 29, 1963
Hart 3,245,641 issued Apr. 12, 1966
Rivers 3,462,102 issued Aug. 19, 1969
Hakala 3,567,164 issued Mar. 2, 1971

Attention is also directed to the U.S. Borst U.S. Pat. No. 3,863,592 issued February 4, 1975 which is directed to a combined dampening and lift means for a marine propulsion device.

Attention is also directed to the U.S. Schimanckas U.S. Pat. No. 3,875,329 issued Jan. 15, 1974 which is directed to a combined reverse lock and swivel bracket holding mechanism.

SUMMARY OF THE INVENTION

The invention provides a mounting device for a marine propulsion device comprising a first bracket adapted to be attached to a boat and having upper and lower parts, a second bracket adapted to support a marine propulsion device and having upper and lower parts, an upper link pivotally connected at its ends to the upper parts of the first and second brackets, a lower link pivotally connected at its ends to the lower parts of the first and second brackets, whereby to permit swinging of the second bracket relative to the first bracket between raised and lowered positions, means for selectively holding the second bracket in the first and second positions including a slot means and stud means engaged in the slot means and means for selectively and yieldably biasing one of the slot means and stud means for engagement with the other so as to selectively retain the second bracket in either of the raised and lowered positions.

In one embodiment in accordance with the invention, the slot means comprises an elongated slot located in the first bracket and having at the opposed ends thereof oppositely extending notches and the stud means includes a stud extending into the slot for travel therein in response to movement of the second bracket relative to the first bracket, which second bracket is held in one of the raised and lowered positions when the stud is in one of the notches and which second bracket is held in the other of the raised and lowered positions when the stud is in the other of the notches.

In one embodiment in accordance with the invention, the means for selectively and yieldably biasing one of the slot means and stud means comprises an operating lever carried for pivotal movement in opposite directions, and over-center-means for selectively yieldably biasing the lever in opposite directions so as thereby to yieldably bias the stud means so as to selectively hold the second bracket in either on of the raised and lowered positions.

The invention also provides a mounting device for a marine propulsion device comprising a first bracket adapted to be attached to a boat and having upper and lower parts, a second bracket adapted to support a marine propulsion device and having upper and lower parts, and upper link pivotally connected at its ends to the upper parts of the first and second brackets, a lower link pivotally connected at its ends to the lower parts of the first and second brackets, whereby to permit swinging of the second bracket relative to the first bracket between raised and lowered positions, means for selectively holding the second bracket in the first and second positions including a latching arm pivotally carried by one of the brackets and links for movement so as to selectively hold the second bracket in either one of the raised and lowered positions, and means for selectively and yieldably biasing the latching arm so as to selectively retain the second bracket in either of the raised and lowered positions.

In one embodiment, the means for selectively and yieldably biasing the latching arm comprises an operating lever carried coaxially with the locking arm for pivotal movement in opposite directions, which lever includes means selectively engagable with the latching arm to selectively pivot the latching arm so as to selectively hold the second bracket in either one of the raised and lowered positions, and over-center-means for selectively yieldably biasing the lever in opposite directions so as thereby to yieldably pivot the arm so as to selectively hold the second bracket in either one of the raised and lowered positions.

In one embodiment, the latching arm includes therein an elongated slot having, at the opposed ends thereof, oppositely extending notches and the selective holding means further includes a stud on another one of the brackets and the links and extending therefrom into the slot for travel therein in response to movement of the second bracket relative to the first bracket so as to hold the second bracket in one of the raised and lowered positions when the stud is in one of the notches and so as to hold the second bracket in the other of the raised and lowered positions when the stud is in the other of the notches.

In one embodiment of the invention, the mounting device further includes stop means extending from one of the brackets and from one of the links for engagement to support the load thereof when the second bracket is in the lowered position.

In an embodiment of the invention, the mounting device further includes a shock absorbing and tilting assembly comprising a cylinder connected to one of the links and the brackets and a piston assembly extending in the cylinder and connected to another of the links and the brackets. Preferably, in accordance with one embodiment, the shock absorber and tilting assembly is pressurized with gas so as to bias the second bracket toward the raised position.

In one embodiment, the links extend in parallel relation to each other and the brackets extend in parallel relation to each other.

The invention also provides a mounting device for a marine propulsion device comprising a first bracket adapted to be attached to a boat and having upper and lower parts, a second bracket adapted to support a marine propulsion device and having upper and lower parts, an upper link pivotally connected at its ends to the upper parts of the first and second brackets, a lower link pivotally connected at its ends to the lower parts of the first and second brackets, whereby to permit swinging of the second bracket relative to the first bracket between raised and lowered positions, an assist arm pivotally connected to one of the links and the second bracket, and means adapted to be fixed relative to the boat and on the assist arm for releasably and selectively fixing the assist arm relative to the boat so as to releasably locate the second bracket.

One of the principal features of the invention is the provision of a motor supporting linkage of the general type described herein including a selectively operable and yieldably biased operating mechanism for releasably retaining the supported motor in either of the raised or lowered position.

Another of the principal features of the invention is the provision of a motor supporting linkage of the general type disclosed herein including an over-the-center biased operating lever which is operable to selectively afford retension and release of the motor supporting device in either of a raised or lowered position.

Another of the principal features of the invention is provision of a motor supporting linkage of the general type disclosed herein including a tilt assist assembly which, preferably, is also operable to provide a shock absorbing function.

Other features and advantages of the embodiments of the invention will become apparent by reference to the following general description, appended claims, and drawings.

THE DRAWINGS

Figure 1:
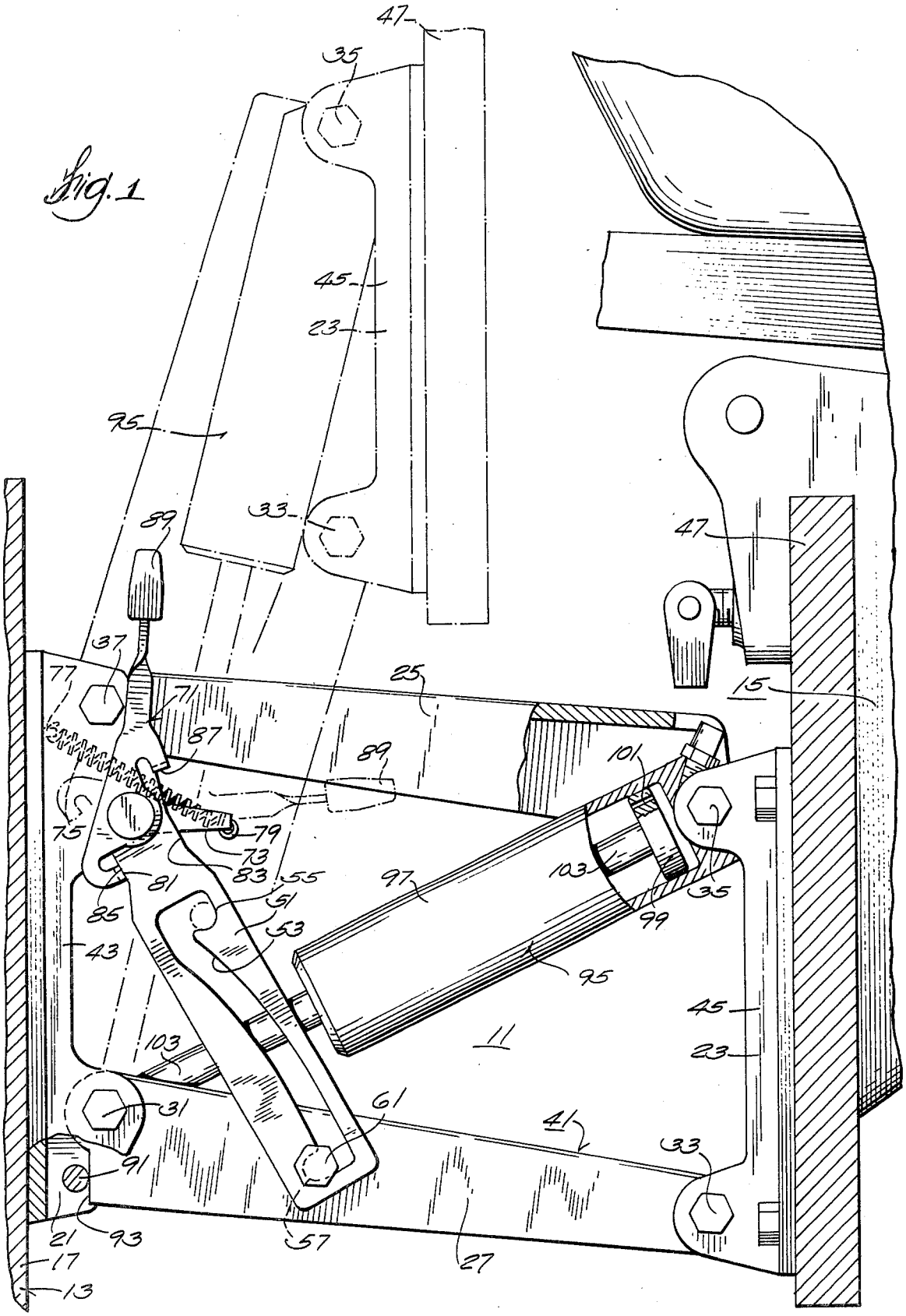
FIG. 1 is a side elevational view, with parts broken away and in section, of a device which is adapted for mounting a marine propulsion device to a boat and which embodies various of the features of the invention.

Before explaining the embodiments of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein is for purposes of description and should not be regarded as limiting.

GENERAL DESCRIPTION

Shown in the drawings is a device 11 for supporting any suitable marine propulsion device from a boat hull 13. Preferably, the marine propulsion device is an outboard motor 15, and the device is attached to the stern or transom 17 of the boat hull 13.

The device 11 comprises a first or transom bracket 21 adapted to be attached to the boat transom 17, a second bracket 23 adapted to support the outboard motor 15, and upper and lower links 25 and 27 respectively which are pivotally connected at 31, 33, 35 and 37 to the brackets 21 and 23 to provide a parallelogram linkage 41 movable between a first position locating the second or outboard motor supporting bracket 23 in the lowered position (shown in full lines in FIG. 1) and a second position locating the second or outboard motor supporting bracket 23 in a raised position (shown in dotted lines in FIG. 1).

Figure 2:
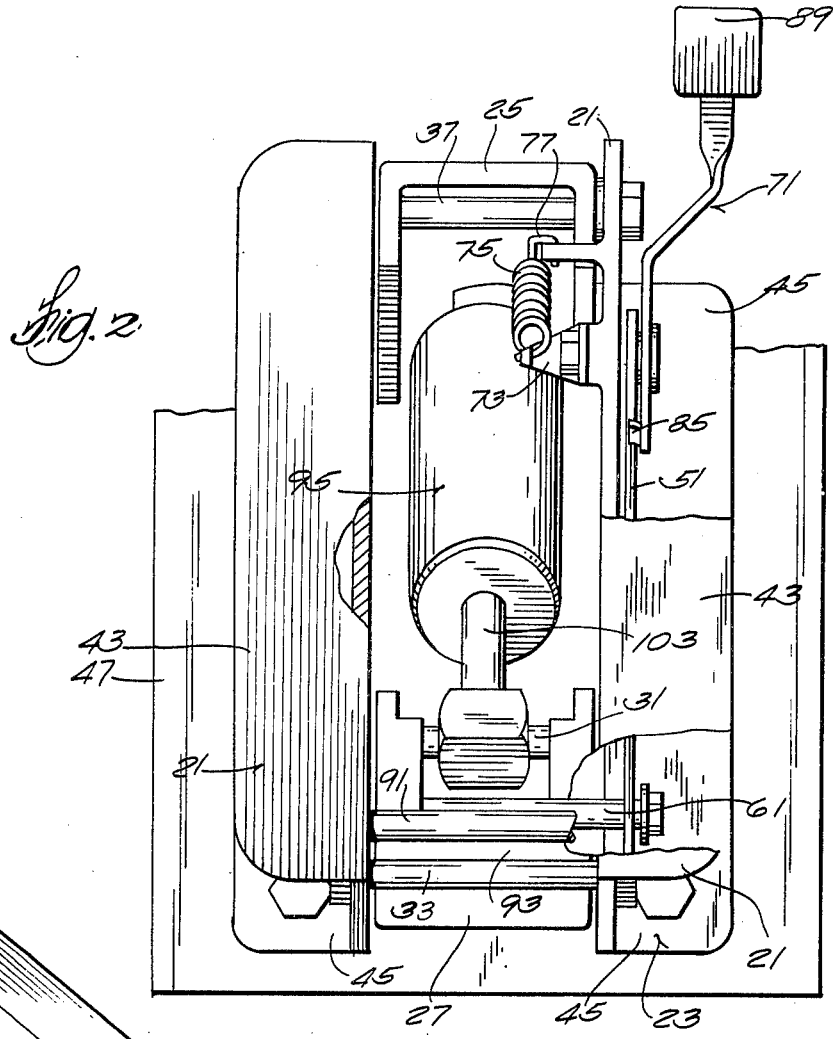
FIG. 2 is a front end view, with parts omitted and parts broken away and in section, of the device shown in FIG. 1.

The transom or first bracket 21 can comprises one or more parts. In FIG. 2, the bracket 21 is shown as including two similarly constructed bracket parts 43 attached to the boat transom 17 in parallel relation to each other.

Similarly, the second or outboard motor supporting bracket 23 can comprises one or more parts. In FIG. 2, the bracket 23 is shown as including two similarly constructed bracket parts 45 which are attached, in spaced parallel relation to each other, to a mounting board or part 47 (See FIG. 1) to which the outboard motor 15 is connected.

The upper and lower links 25 and 27 preferably are generally identically constructed, are of generally U-shaped cross section, and are arranged with the open ends of the U-shaped cross sections in facing relation.

The pivotal connections 31, 33, 35 and 37 are provided by respective bolts which extend through the pivotally connected components.

Means are provided for selectively holding the device 11 with the second or motor supporting bracket 23 in either one of the raised or lowered positions. While various arrangements can be employed, in the construction illustrated in the drawings, the holding means comprises an elongated latching arm 51 which is pivotally carried, at its upper end, by one of the brackets 21 and 23 (the transom bracket 21 in the illustrated construction) and which includes an arcuate elongated slot 53 having, at the opposite upper and lower ends thereof, oppositely projecting upper and lower end notches 55 and 57.

Extending from one of the links 25 and 27 (the bottom link 27 in the illustrated construction) is a stud or bolt 61 which projects into the slot 53 and is selectively receivable in the end notches 55 and 57. Accordingly, during movement of the device 11 between its raised and lowered positions, the stud 61 travels throughout the length of the slot 53 and the latching arm 51 pivots slightly relative to the transom bracket 21. When the stud 61 is received in the lower notch 57, the device 11 is retained with the motor supporting bracket 23 in the lower position and when the stud 61 is received in the upper notch 55, the device is retained with the motor supporting bracket 23 in the raised position.

Means are provided for selectively and yieldably biasing the latching arm 51 so as to selectively retain the motor supporting bracket 23 in either of the raised and lowered positions. Thus, in the disclosed construction, the latching arm 51 is selectively and yieldably biased to effect receipt of the stud 61 in the notches 55 and 57 at the ends of the slot 51.

More specifically, while other constructions can be employed, in the disclosed construction, the means for releasable and yieldable biasing the latching arm 51 comprises an operating lever 71 which is carried by the mounting bracket 21 co-axially with the latching arm 51 for pivotal movement in opposite directions, together with inter-engaging parts on the latching arm 51 and on the operating lever 71 for pivotally displacing the latching arm 51 in response to pivotal movement of the operating lever 71, and over-the-center spring means for selectively biasing the operating lever 71 for pivotal movement in opposite directions and thereby to also selectively bias the latching arm 51 for pivotal movement in opposite directions so as to retain the stud 61 in the notches 55 and 57 at the ends of the slot 53.

Still more specifically, while other constructions could be employed, in the illustrated construction, the operating lever 71 has connected thereto, for common pivotal movement therewith, a radially extending arm 73. The over-the-center biasing means comprises a helical spring 75 which, at one end, is anchored to the transom or mounting bracket 21 at 77 and which, at the other end, is connected to the arm 73 at 79 so as to urge the arm 73 and connected operating lever 71 in opposite pivotal directions from an unstable central position. The inter-engaging means on the operating lever 71 and on the latching arm 73 includes spaced edged portions 81 and 83 located on the latching arm 51 at substantially equal radial distances from the pivotal axis of the latching arm 51 and, on the operating lever 71, spaced abutments 85 and 87 which are located at a common radius from the pivotal axis, which are respectfully adapted to engage the edge portions 81 and 83 so as to pivot the latching arm 51 in response pivotal movement of the operating lever 71, and which are arcuately spaced from each other at a distance greater than the arcuate spacing of the edge portions 81 and 83 so as to thereby permit lost motion between the operating lever 71 and the latching arm 51 during the range of travel of the operating lever 71 to either side of the unstable central position. As shown in FIG. 1, the operating lever 71 also includes a handle portion 89 facilitating manual movement of the operating lever 71 against the action of the spring 75 to either side of the unstable central position.

Thus, the over-the-center spring 75 serves to selectively bias the operating lever 71 in opposite directions from the unstable central position and, acting through the operating lever 71 and through selective respective engagement between the abutments 85 and 87 and the edge portions 81 and 83, to selectively bias the latching arm 51 into positions which are effective to selectively retain the stud 61 in either of the upper and lower notches 55 and 57 so as to retain the motor support bracket 23 in the raised or lowered positions.

Means are also provided for supporting the weight of the linkage and supported outboard motor 15 when the motor support bracket 23 is in the lowered position. While other constructions are possible, in the illustrated construction, such means comprises a bolt which extends from one of the links and brackets 21, 23, 25 and 27 and which engages a surface on an adjacent one of the links or brackets 21, 23, 25 amd 27. Thus in the illustrated construction, the mounting or transom bracket 21 supports a bolt or stud 91 which engages an edge or surface 93 on the adjacent end of the lower link 27 to support the linkage when the motor mounting bracket 23 is in the lowered position.

Means can also be provided for assisting in raising the device 11 and supported motor 15 from the lowered position to the raised position.

Thus, in the illustrated construction, the device includes a tilting assist assembly 95. More specifically, the tilting assist assembly 95 is pivotally connected at its opposite ends to one pair of the diagonally opposed pivotal connections included in the device 11. Still more specifically, the tilting assist assembly comprises a hydraulic cylinder 97 which is pivotally connected to the pivotal connection 35 between the motor support bracket 23 and upper link 25 and which includes therein a piston assembly including a piston 99 which is reciprocal in the cylinder 97, which is formed to provide an orifice 101 restraining fluid flow from one side to the other of the piston 99 so as to prevent excessively rapid movement of the piston 99 in the cylinder 97 and which is connected to a piston rod 103 which is pivotally connected to the pivotal connection 31 between the lower link 25 and the transom bracket 21.

Preferably, in order to assist in tilting, the cylinder 97 is only partially occupied with hydraulic fluid and is additionally pressurized with gas. Such pressurization can be at a level which effectively reduces the weight of the device 11 and supported outboard motor 15, thereby reducing the effort necessary to elevate the device 11 and supported outboard motor 15 to the raised position. In addition such pressurization serves to reduce or eliminate drag when attempting to raise the outboard motor 15 under operating conditions and reduces the rate of descent of the motor 15 from the raised to the lower position. If desired, the cylinder 97 can be pressurized to a level which overbalances the weight of the device 11 and the supported outboard motor 15 and which is therefore effective to raise the device 11 and supported motor 15 from the lowered position to the elevated position so as to require manual force to lower the device 11 and supported motor 15 from the raised position to the lowered position.

If desired, a handle can extend from one of the movable links 25 and 27 or motor supporting bracket 23 to assist in manual manipulation of the device 11.

In operation, the operating lever 71 is displaced manually over-center. Thereafter, the spring 75 urges the operating lever 71 so as to engage one of the abutments 85 and 87 with one of the edge portions 81 and 83 and thereby biases the latching arm 51 to retain the stud 61 in one of the end notches 55 and 57 so as thereby to retain the motor support bracket 23 in one of the raised or lowered positions. When it is desired to shift the motor support bracket 23 from one to the other of the raised and lowered positions, the manual operating lever 71 is displaced over-center and the spring 75 again acts to bias the operating lever 71 into engagement with the latching arm 51 and to displace the latching arm 51 so as to permit removal of the stud 61 from the engaged one of the notches 55 and 57 and into the adjacent end of the slot 53 for travel therein consequent to movement of the motor support bracket 23 between its positions. At the other end of the slot 53, the bias provided by the spring 75 to the latching arm 51 serves to move the latching arm 51 in order to receive and retain the stud 61 in the other one of the end notches 55 and 57 and thereby to selectively retain the motor support bracket 23 in the raised or lowered position. As already explained, the tilt assist assembly 95 can be employed either to reduce the weight of the device 11 and supported motor 15 or to positively bias the device 11 and supported motor 15 toward the raised position.

Figure 3:
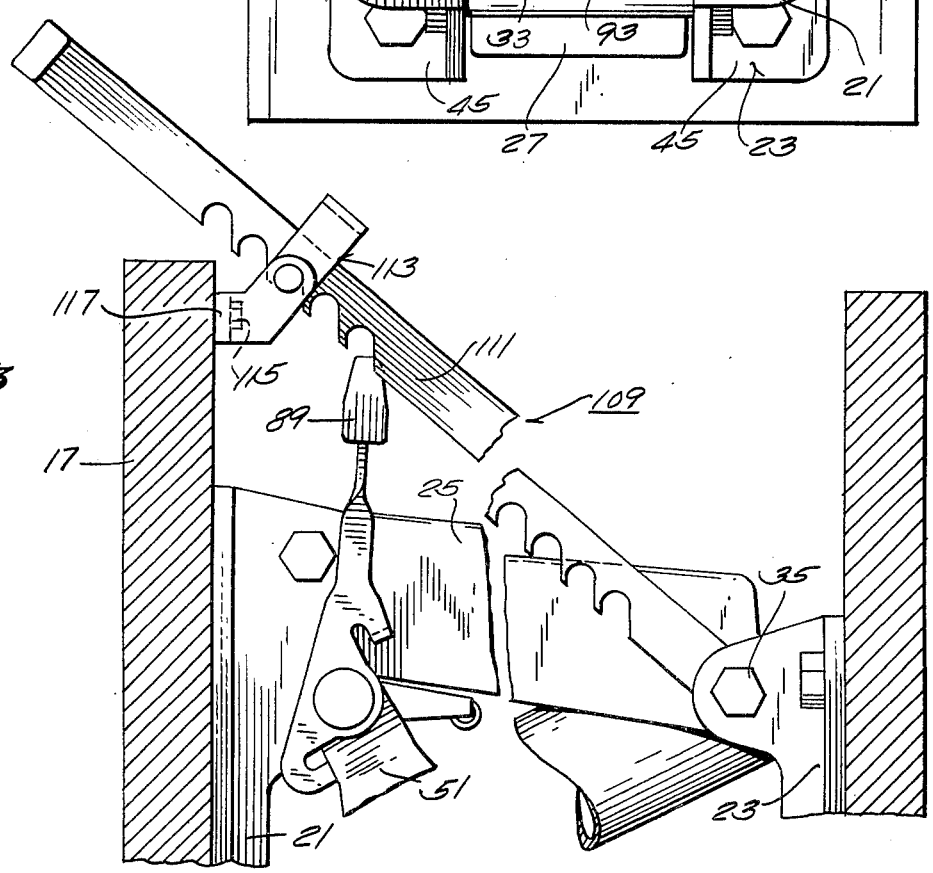
FIG. 3 is a fragmentary view of a modified construction.

Shown in FIG. 3 is a device 109 which is generally identical to the device 11 shown in FIGS. 1 and 2 except that an arm 111 is employed to assist in raising and lowering the motor supporting bracket 23 and to provide retention of the supporting bracket 23 in one or more positions intermediate the raised and lowered positions.

More specifically, while the assist arm 111 could be connected to the device in various ways, in the illustrated construction, the assist arm 111 is attached to the pivotal connection 35, extends toward the boat transom 17, and passes through a U-shaped guide bracket 113 which is pivotally mounted on a cross stud or pin 115 supported by a bracket 117 fixed to the boat transom 17 at a point above the top of the mounting bracket 21. If desired, the bracket 117 count be formed as a part of the mounting bracket 21.

In order to provide selective retention of the motor supporting bracket 23 in one or more intermediate positions, the arm 111 includes one or more notches 121 which are engageable with the cross stud 115 to hold the motor support bracket 23 against pivotal movement. As illustrated, a plurality of notches 121 are provided to provide additional support bracket locations adjacent to each of the raised and lowered positions.

If desired, the device 109 can be constructed with the assist arm 111 as the sole mechanicam for raising and lowering the motor support bracket 23, with or without the tilting assist and shock absorber assembly 95. In such circumstances, the latching arm 51, the operating lever 71, and other components relative thereto, can be omitted.

Figure 4:
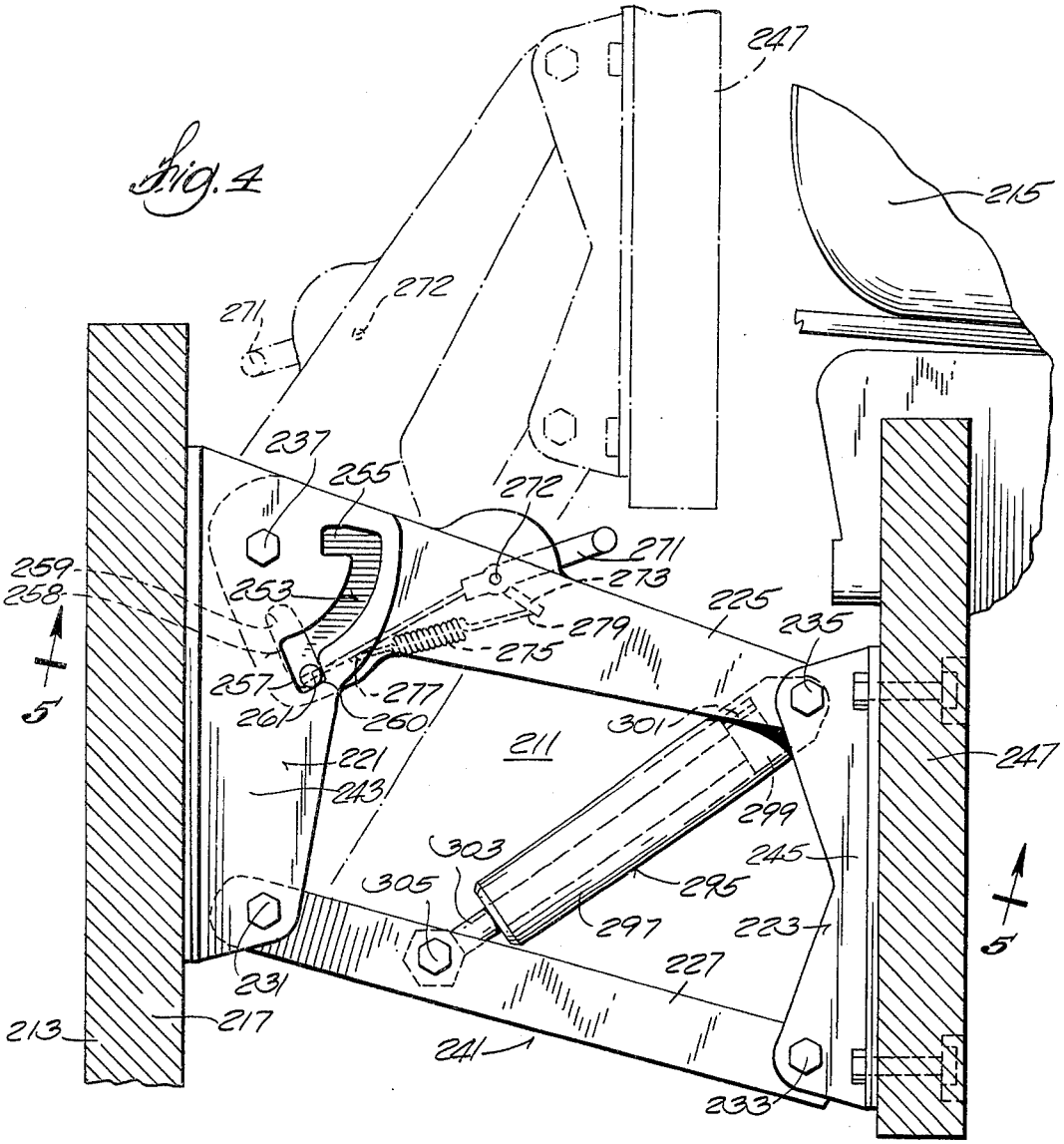
FIG. 4 is a side elevational view, with parts in section, of another device which is adapted for mounting a marine propulsion device to a boat and which embodies various of the features of the invention.
Figure 5:
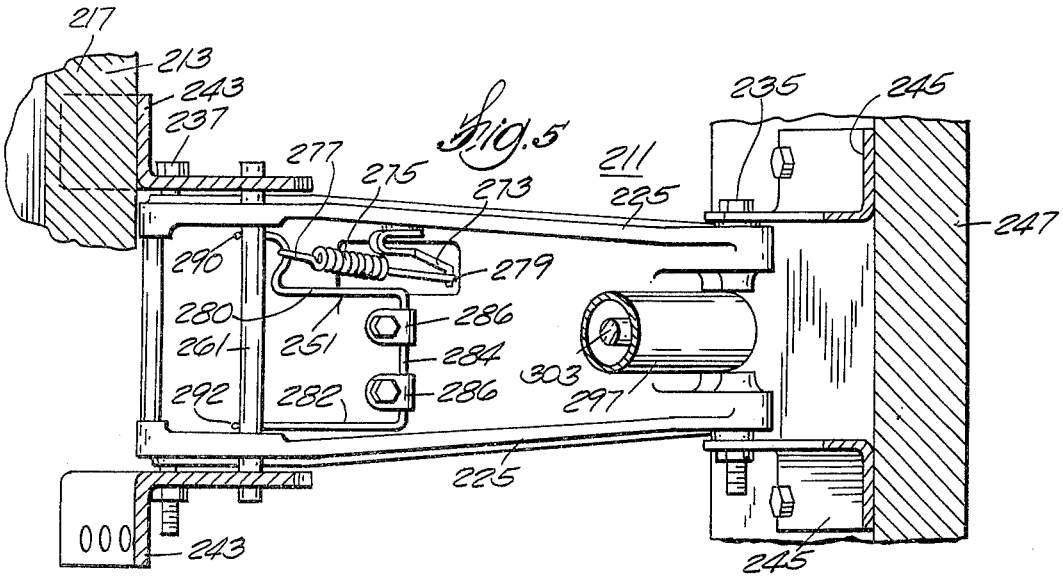
FIG. 5 is a sectional view taken along line 5—5 of FIG. 4.

Shown in FIGS. 4 and 5 is still another device 211 for supporting any suitable marine propulsion device such as the outboard motor 215 from the stern or transom 217 or other part of a boat hull 213.

The device 211 comprises a first or mounting or transom bracket 221 adapted to be attached to the boat transom 217, a second bracket 223 adapted to support the outboard motor 215, and upper and lower links 225 and 227 respectively which are pivotally connected at 231, 233, 235 and 237 to the brackets 221 and 223 to provide a parallelogram linkage 241 movable between a first position locating the second or outboard motor supporting bracket 223 in the lowered position (shown in full lines in FIG. 4) and a second position locating the second or outboard motor supporting bracket 223 in a raised position (shown in dotted lines in FIG. 4).

The transom or first bracket 221 can comprise one or more parts. In FIG. 5, the bracket 221 is shown as including two similarly constructed bracket parts 243 adapted to be attached to the boat transom 217 in parallel relation to each other.

Similarly, the second or outboard motor supporting bracket 223 can comprise one or more parts. In FIG. 5, the bracket 223 is shown as including two similarly constructed bracket parts 245 which are attached, in spaced parallel relation to each other, to a mounting board or part 247 to which the outboard motor 215 is connected.

The pivotal connections 231, 233, 235 and 237 are provided by respective bolts which extend through the pivotally connected components.

Means are provided for selectively holding the device 211 with the second or motor supporting bracket 223 in either one of the raised or lowered positions. While various arrangements can be employed, in the construction illustrated in FIGS. 4 and 5 of the drawings, the holding means comprises an actuating links 251 which is carried by the upper link 225, together with transversely spaced arcuate elongated slots 253 which extends in the mounting bracket parts 243 at a uniform radius from the pivotal connection 237 and which have, at the opposite upper and lower ends thereof, oppositely projecting upper and lower end notches 255 and 257. In addition, the holding means includes transversely spaced elongated slots 258 which extend in the upper links 225 in generally parallel relation to the slots 257 when the motor supporting bracket 223 is in the lowered position shown in FIG. 4, and which have opposed ends 259 and 260, together with a stud or bolt 261 which, as will be described, is carried by the actuating links 251, and which has opposed ends projecting into the slots 253 and 258. Accordingly, during movement of the device 211 between its raised and lowered positions, the stud 261 travels throughout the length of the slots 253 and throughout the length of the slots 258. When the stud 261 is located in the lower notches 257 and in the ends 260 of the slots 253, the device 211 is retained with the motor supporting bracket 223 in the lower position and when the stud 261 is located in the upper notches 255 and in the ends 259 of the slots 258, the device 211 is retained with the motor supporting bracket 223 in the raised position.

Means are provided for selectively and yieldably biasing the stud 261 so as to selectively retain the motor supporting bracket 223 in either of the raised and lowered positions. Thus, in the disclosed construction, the stud 261 is selectively and yieldably biased to effect receipt thereof and to retain the stud 261 in the notches 255 and 257 at the ends of the slots 253 and in the ends 259 and 260 of the slots 258.

More specifically, while other constructions can be employed, in the disclosed construction, the means for releasably and yieldably biasing the stud 261 comprises an operating lever 271 which is pivotally carried at 272 by the upper link 225 for pivotal movement in opposite directions and over-the-center spring means for selectively biasing the operating lever 271 for pivotal movement in opposite directions from an unstable centered position and thereby to also selectively bias the stud 261 so as to selectively retain the stud 261 in the notches 255 and 257 at the ends of the slots 253 and in the ends 259 and 260 of the slots 258.

Still more specifically, while other constructions could be employed, in the illustrated construction, the operating lever 271 has connected thereto, for common pivotal movement therewith, a radially extending arm 273. The over-the-center biasing means comprises a helical spring 275 which, at one end, is connected at 277 (See FIG. 5) to the actuating link 251 which is generally of U-shape including a pair of legs 280 and 282 extending from a web portion 284 which is pivotally attached to the upper link 225 by suitable clamp elements 286. At their free ends, the legs 280 and 282 terminate in respective portions 290 and 292 which extend through apertures in the stud 261 so as to permit floating of the stud 261 on the link 251. Disconnection of the stud 261 from the link 251 is prevented by engagement of the ends of the stud 261 with the edges of the slots 258 in the upper link 225. At its other end, the spring 275 is connected to the arm 273 at 279 so as to urge the arm 273 and connected operating lever 271 in opposite pivotal directions from the unstable central position and thereby to selectively arcuately bias the stud 261 toward the end notches 255 and 257 of the slots 253 and into the ends 259 and 260 of the slot 258.

Thus, the over-the-center spring 275 serves both to selectively bias the operating lever 271 in opposite directions from the unstable central position and, acting through the actuating link 251, to bias the stud 261 into positions which are effective to selectively retain the stud 261 in either of the upper and lower notches 255 and 257 and the associated one of the slot ends 259 and 260 so as to retain the motor support bracket 223 in the raised or lowered positions.

Means can also be provided for assisting in raising the device 211 and support motor 215 from the lowered position to the raised position. Thus, in the illustrated construction the device 211 includes a tilting assist assembly 295. More specifically, the tilting assist assembly 295 comprises a hydraulic cylinder 297 which is pivotally connected to the pivotal connection 235 between the motor support bracket 223 and the upper link 225 and which includes therein a piston assembly including a piston 299 which is reciprocal in the cylinder 297, which is formed to provide an orifice 301 restraining fluid flow from one side to the other of the piston 299 so as to prevent excessively rapid movement of the piston 299 in the cylinder 297 and which is connected to a piston rod 303 which is pivotally connected to the lower link 227 at 305.

Preferably, in order to assist in tilting, the cylinder 297 is only partially occupied with hydraulic fluid and is additionally pressurized with gas. Such pressurization can be at a level which effectively reduces the weight of the device 211 and supported outboard motor 215, thereby reducing the effort necessary to elevate the device 211 and supported outboard motor 215 to the raised position. In addition, such pressurization serves to reduce or eliminate drag when attempting to raise the outboard motor 215 under operating conditions and reduces the rate of descent of the motor 215 from the raised to the lowered position. If desired, the cylinder 297 can be pressurized to a level which overbalances the weight of the device 211 and the supported outboard motor 215 and which is therefore effective to raise the device 211 and supported motor 215 from the lowered position to the elevated position and so as to require manual force to lower the device 211 and supported motor 215 from the raised position to the lowered position.

If desired, a handle (not shown) can extend from one of the movable links 225 and 227 or motor supporting bracket 223 to assist in manual manipulation of the device 211.

In operation, the spring 275 serves to releasably retain the stud 261 in one of the end notches 255 and 257 so as thereby to retain the motor support bracket 223 in one of the raised or lowered positions. When it is desired to shift the motor support bracket 223 from one to the other of the raised and lowered positions, the manual operating lever 271 is displaced over-center against the bias of the spring 275 and, when the operating lever 271 is relocated, the spring 275 acts through the actuating link 251 to bias the stud out of the engaged one of the end notches 255 and 257 and the associated ones of the slot ends 259 and 261 for travel in the slots 253 and 258 consequent to pivotal movement of the bracket 223 relative to the bracket 221. When the bracket 223 is relocated in the other one of the raised and lowered positions, the spring 275 acts to urge the stud 261 into the other of the notches 255 and 257 and the associated ones of the slot ends 259 and 260 to thereby selectively retain the motor support bracket 223 in the other of the raised or lowered position. As already explained, the tilt assist assembly 295 can be employed either to reduce the weight of the device 211 and supported motor 215 or to positively bias the device 211 and supported motor 215 toward the raised position.

The assist arm 111 shown in FIG. 3 can also be employed with the device 211.

Various of the features of the invention are set forth in the following claims:

What is claimed is:

1. A mounting device for a marine propulsion device comprising a first bracket adapted to be attached to a boat and having upper and lower parts, a second bracket adapted to support a marine propulsion device and having upper and lower parts, an upper link pivotally connected at its ends to said upper parts of said first and second brackets, a lower link pivotally connected at its ends to said lower parts of said first and second brackets, whereby to permit swinging of said second bracket relative to said first bracket between first and second positions, and means for selectively holding said second bracket in said first and second positions including a latching arm pivotally carried by one of said brackets and said links for movement so as to selectively prevent movement of said second bracket from either one of said first and second positions in the direction toward the other of said first and second positions, and means for selectively and yieldably biasing said latching arm so as to selectively hold said second bracket in either of the raised and lowered positions.

2. A mounting device in accordance with claim 1 and further including stop means extending from one of said brackets and from one of said links for engagement to support the load thereof when said second bracket is in said lowered position.

3. A mounting device in accordance with claim 1 and further including a shock absorbing and tilting assembly comprising a cylinder connected to the pivotal connection between one of said links and one of said brackets and a piston assembly extending in said cylinder and connected to the pivotal connection between the other of said links and the other of said brackets.

4. A mounting device in accordance with claim 3 wherein said shock absorber and tilting assembly is pressurized with gas so as to bias said second bracket toward said raised position.

5. A mounting device in accordance with claim 1 wherein said links extend in parallel relation to each other and said brackets extend in parallel relation to each other.

6. A mounting device in accordance with claim 1 wherein said latching arm includes therein an elongated slot having at the opposed ends thereof oppositely extending notches and wherein said selective holding means further includes a stud on another one of said brackets and said links and extending therefrom into said slot for travel therein in response to movement of said second bracket relative to said first bracket, said second bracket being held in one of said first and second positions when said stud is in one of said notches and said second bracket being held in the other of said first and second positions when said stud is in the other of said notches.

7. A mounting device in accordance with claim 1 wherein said means for selectively and yieldably biasing said latching arm comprises an operating lever carried coaxially with said locking arm for pivotal movement in opposite directions, said lever including means selectively engagable with said latching arm to selectively pivot said latching arm so as to selectively hold said second bracket in either one of said first and second positions, and over-center-means for selectively yieldably biasing said lever in opposite directions so as thereby to yieldably pivot said arm so as to selectively hold said second bracket in either one of said first and second positions.

8. A mounting device in accordance with claim 7 wherein said means selectively engageable with said latching arm includes a pair of abutments arcuately spaced from each other at a distance greater than the arcuate extent of said latching arm.

9. A mounting device in accordance with claim 1 and further including an assist arm pivotally connected to one of said links and said second bracket, and means adapted to be fixed relative to the boat and on said assist arm for releasably and selectively fixing said assist arm relative to the boat so as to releasably locate said second bracket.

10. A mounting device in accordance with claim 9 and further including means for guiding movement of said assist arm relative to said means adapted to be fixed relative to the boat.

11. A mounting device in accordance with claim 1 and further including an assist arm pivotally connected to the pivotal connection between said upper link and said second bracket, a stud extending transversely and fixed relative to the boat, a guide member connected to said stud for guiding movement of said assist arm relative to said stud, and at least one notch in said assist arm releasably engagable with said stud to releasably locate said second bracket.

12. A mounting device in accordance with claim 1 and further including a shock absorbing and tilting assembly comprising a cylinder and a piston assembly extending in said cylinder, one of said cylinder and said piston assembly being connected to the pivotal connection between one of said links and one of said brackets and the other of said cylinder and said piston assembly being connected to one of the other of said links and the other of said brackets.

13. A mounting device in accordance with claim 12 wherein said shock absorber and tilting assembly is pressurized with gas so as to bias said second bracket toward said raised position.

14. A mounting device for a marine propulsion device comprising a first bracket adapted to be attached to a boat and having upper and lower parts, an upper link pivotally connected at its ends to said upper parts of said first and second brackets, a second bracket adapted to support a marine propulsion device and having upper and lower parts, a lower link pivotally connected at its ends to said lower parts of said first and second brackets, whereby to permit swinging of said second bracket relative to said first bracket between raised and lowered positions, means for selectively holding said device with said second bracket in said first and second positions including a latching arm pivotally carried by one of said brackets for movement so as to selectively hold said second bracket in either one of said raised and lowered positions, an operating lever carried by said one bracket coaxially with said locking arm for pivotal movement in opposite directions, said lever including means selectively engagable with said latching arm to selectively pivot said latching arm so as to selectively hold said second bracket in either one of said raised and lowered positions, and over-center-means for selectively yieldably biasing said lever in opposite directions so as thereby to yieldably pivot said arm so as to selectively hold said second bracket in either one of said raised and lowered positions.

15. A mounting device for a marine propulsion device comprising a first bracket adapted to be attached to the transom of a boat and having upper and lower parts, a second bracket adapted to support a marine propulsion device and having upper and lower parts, an upper link pivotally connected at its ends to said upper parts of said first and second brackets, a lower link pivotally connected at its ends to said lower parts of said first and second brackets, whereby to permit swinging of said second bracket relative to said first bracket between raised and lowered positions, means for selectively holding said device with said second bracket in said first and second positions, said selective holding means comprising a latching arm pivotally carried by one of said brackets for movement so as to selectively hold said second bracket in either one of said raised and lowered positions, said latching arm including therein an elongated slot having at the opposed ends thereof oppositely extending notches, said selective holding means also including a stud on one of said links extending into said slot for travel therein in response to pivotal movement of said one link relative to said one bracket, said device being held with said second bracket in one of said raised and lowered positions when said stud is in one of said notches and said device being held with said second bracket in the other of said raised and lowered positions when said stud is in the other of said notches, an operating lever carried by said one bracket coaxially with said locking arm for pivotal movement in opposite directions and including a pair of abutments arcuately spaced from each other at a distance greater than the arcuate extent of said latching arm, said abutments being selectively engagable with said latching arm to pivot said latching arm so as to selectively hold said second bracket in either one of said raised and lowered positions, and over-center-means for selectively yieldably biasing said lever in opposite directions so as thereby to yieldably pivot said arm so as to selectively locate said arm to receive said stud in a selected one of said notches.

16. A mounting device for a marine propulsion device comprising a first bracket adapted to be attached to a boat and having upper and lower parts, a second bracket adapted to support a marine propulsion device and having upper and lower parts, an upper link pivotally connected at its ends to said upper parts of said first and second brackets, a lower link pivotally connected at its ends to said lower parts of said first and second brackets, whereby to permit swinging of said second bracket relative to said first bracket between first and second positions, and means for selectively holding said second bracket in said first and second positions including means for selectively preventing movement of said second bracket from either one of said first and second positions in the direction toward the other of said first and second positions.

17. A mounting device in accordance with claim 15 and further including an assist arm pivotally connected to one of said links and said second bracket, and means adapted to be fixed relative to the boat and on said assist arm for releasably and selectively fixing said assist arm relative to the boat so as to releasably locate said second bracket.

18. A mounting device in accordance with claim 17 wherein said assist arm is pivotally connected to the pivotal connection between said upper link and said second bracket, wherein said means for releasably and selectively fixing said assist arm includes a stud extending transversely and fixed relative to the boat, and at least one notch in said assist arm releasably engagable with said stud to releasably locate said second bracket.

19. A mounting device in accordance with claim 18 and further including a guide member connected to said stud and engagable with said assist arm for guiding movement of said assist arm relative to said stud.

20. A mounting device in accordance with claim 16 and further including a shock absorbing and tilting assembly comprising a cylinder and a piston assembly extending in said cylinder, one of said cylinders and said piston assembly being connected to the pivotal connection between one of said links and one of said brackets and the other of said cylinder and said piston assembly being connected to one of the other of said links and the other of said brackets.

21. A mounting device in accordance with claim 20 wherein said shock absorber and tilting assembly is pressurized with gas so as to bias said second bracket toward said raised position.

22. A mounting device for a marine propulsion device comprising a first bracket adapted to be attached to a boat and having upper and lower parts, a second bracket adapted to support a marine propulsion device and having upper and lower parts, an upper link pivotally connected at its ends to said upper parts of said first and second brackets, a lower link pivotally connected at its ends to said lower parts of said first and second brackets, whereby to permit swinging of said second bracket relative to said first bracket between raised and lowered positions, and means for selectively holding said second bracket in said raised and lowered positions including slot means, stud means engagable in said slot means so as to selectively prevent movement of said second bracket from either of said raised and lowered positions in the direction toward the other of said raised and lowered positions, and means for selectively and yieldably biasing one of said slot means and stud means for engagement with the other so as to selectively hold said second bracket in either of the raised and lowered positions.

23. A mounting device in accordance with claim 22 and further including a shock absorbing and tilting assembly comprising a cylinder connected to one of said links and said brackets and a piston assembly extending in said cylinder and connected to another of said links and said brackets.

24. A mounting device in accordance with claim 23 wherein said shock absorber and tilting assembly is pressurized with gas so as to bias said second bracket toward said raised position.

25. A mounting device in accordance with claim 22 wherein said links extend in parallel relation to each other and said brackets extend in parallel relation to each other.

26. A mounting device in accordance with claim 22 wherein said slot means comprises an elongated slot located in said first bracket and having at the opposed ends thereof oppositely extending notches and wherein said stud means includes a stud extending into said slot for travel therein in response to movement of said second bracket relative to said first bracket, said second bracket being held in one of said raised and lowered positions when said stud is in one of said notches and said second bracket being held in the other of said raised and lowered positions when said stud is in the other of said notches.

27. A mounting device in accordance with claim 22 wherein said means for selectively and yieldably biasing one of said slot means and said stud means comprises an operating lever carried for pivotal movement in opposite directions, and over-center-means for selectively yieldably biasing said lever in opposite directions so as thereby to yieldably bias said stud means so as to selectively hold said second bracket in either one of said raised and lowered positions.

28. A mounting device in accordance with claim 22 and further including an assist arm pivotally connected to one of said links and said second bracket, and means adapted to be fixed relative to the boat and on said assist arm for releasably and selectively fixing said assist arm relative to the boat so as to releasably locate said second bracket.

29. A mounting device in accordance with claim 22 and further including an assist arm pivotally connected to the pivotal connection between said upper link and said second bracket, a pin extending transversely and fixed relative to the boat, a guide member connected to said pin for guiding movement of said assist arm relative to said pin, and at least one notch in said assist arm releasably engagable with said pin to releasably locate said second bracket.

* * * * *

UNITED STATES PATENT OFFICE

CERTIFICATE OF CORRECTION

Patent No. 4,013,249 Dated March 22, 1977

Inventor(s) Martin H. Meyer et al.

It is certified that error appears in the above-identified patent and that said Letters Patent are hereby corrected as shown below:

IN THE ABSTRACT:

| | |
|---|---|
| Line 6 | "end" should be ---ends---. |
| Column 7, line 9 | "count" should be ---could---. |
| Column 7, line 63 | "links" should be ---link---. |
| Column 11, line 62 | "locking" should be --latching--. |

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*